US005113056A

United States Patent [19]

Kuhn

[11] Patent Number: 5,113,056

[45] Date of Patent: May 12, 1992

[54] STORED-SPRING-ENERGY ACTUATOR MECHANISM FOR A HIGH-VOLTAGE CIRCUIT BREAKER

[75] Inventor: Max Kuhn, Unterentfelden, Switzerland

[73] Assignee: Sprecher Energie AG, Oberentfelden, Switzerland

[21] Appl. No.: 550,759

[22] Filed: Jul. 10, 1990

Related U.S. Application Data

[63] Continuation-in-part of Ser. No. 283,869, Dec. 13, 1988, Pat. No. 4,968,861.

[30] Foreign Application Priority Data

Dec. 14, 1987 [CH] Switzerland ..... 861/87

[51] Int. Cl.[5] ..... H01H 5/00; H01H 35/38

[52] U.S. Cl. ..... 200/400; 185/40 R; 74/89.19; 200/501; 200/82 R; 200/81 R

[58] Field of Search ..... 200/400, 501, 82 R, 200/81 R, 82 C; 185/40 R; 74/89.18, 89.19

[56] References Cited

U.S. PATENT DOCUMENTS

| | | | |
|---|---|---|---|
| 2,769,874 | 11/1956 | Coggeshall et al. | 200/400 |
| 2,820,119 | 1/1958 | Miller et al. | 200/400 |
| 3,062,934 | 11/1962 | Hidde Nijland | 200/82 R |
| 3,383,853 | 5/1968 | Engel et al. | 200/400 |
| 4,067,328 | 1/1978 | Manley | 128/205.16 |
| 4,118,613 | 10/1978 | Barkan et al. | 200/82 B |
| 4,156,803 | 5/1979 | Barkan | 200/400 |
| 4,578,551 | 3/1986 | Lin | 200/400 |
| 4,836,198 | 6/1989 | Gates | 128/205.18 |

*Primary Examiner*—Henry J. Recla
*Assistant Examiner*—Keith Kupferschmid
*Attorney, Agent, or Firm*—Fleit, Jacobson, Cohn, Price, Holman & Stern

[57] ABSTRACT

The stored-spring-energy actuator mechanism (210) for the high-voltage circuit breaker (218) has a spiral spring (216) which can be loaded by means of the loading device (212). The high-voltage circuit breaker (218) can be switched on once and off once with the energy stored in the loaded spiral spring (216). The energy stored in the fluid-pressure accumulator (258) is sufficiently great to charge the spiral spring (216) at least once. The working-stroke movement of the piston rod (242) in arrow direction (A) is transformed via the gear segment (236) into a rotation through 360° of the gear (232) meshing with this gear segment (236). The spiral spring (216) is thereby loaded via the loading lever (230). When the three-way valve (256) is changed over, the cylinder-piston unit (214) is hydraulically connected to the low-pressure reservoir (266), as a result of which the gear segment (236) is pivoted back under the force of the restoring spring (250), and the piston-cylinder unit (214) is moved back into the inoperative position. Unloading of the spiral spring (216) is prevented by the backstop (232), and the coupling between the loading lever (230) and the gear (232) is neutralized by a freewheel. It is possible to drive the cylinder-piston unit (214) with thin-bodied hydraulic oil, which permits reliable working in a wide temperature range.

11 Claims, 1 Drawing Sheet

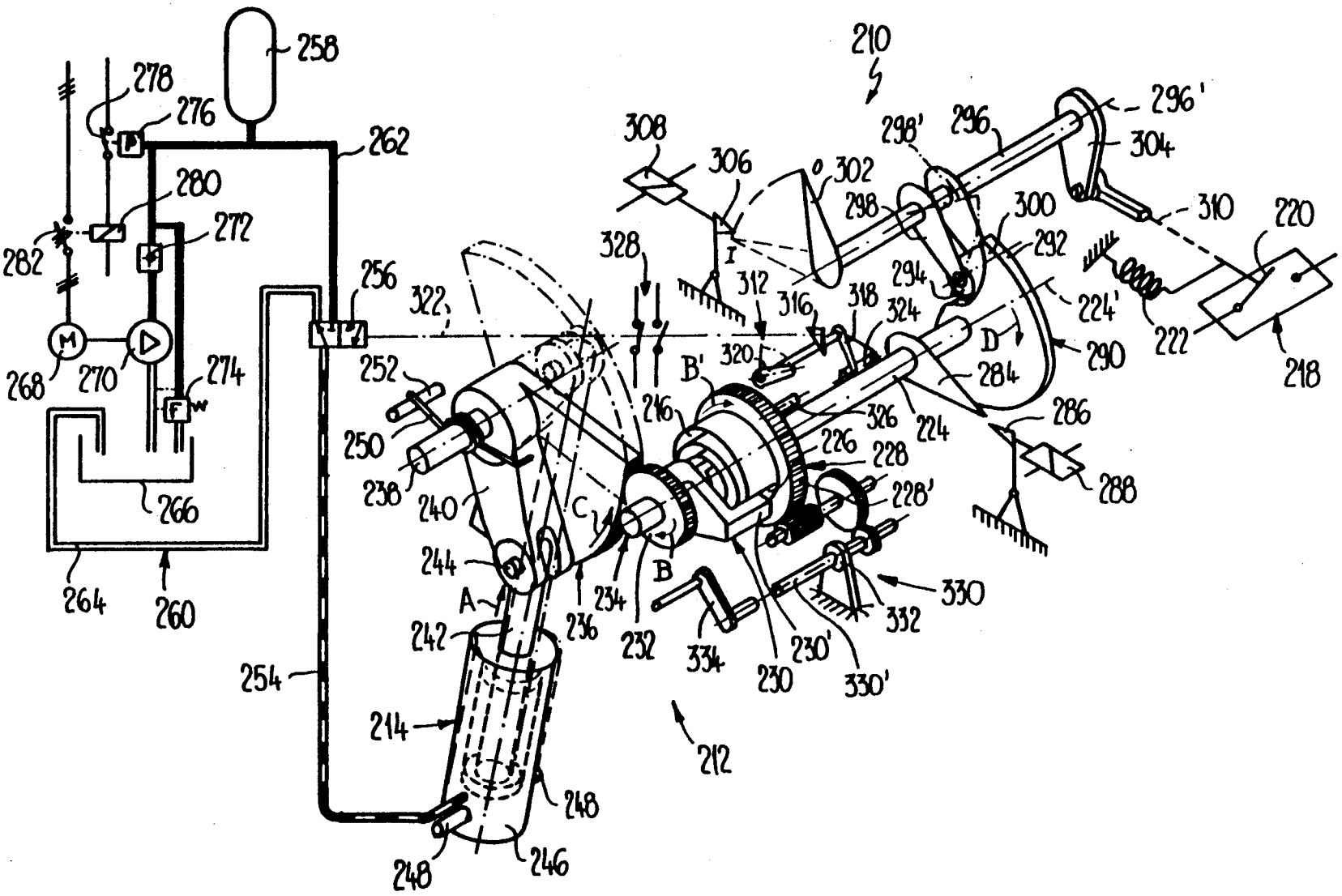
210
212
214
216
218
220
222
224
224'
226
228
228'
230
230'
232
234
236
238
240
242
244
246
248
250
252
254
256
258
260
262
264
266
268
270
272
274
276
278
280
282
284
286
288
290
292
294
296
296'
298
298'
300
302
304
306
308
310
312
316
318
320
322
324
326
328
330
330'
332
334
A
B
B'
C
D
I

STORED-SPRING-ENERGY ACTUATOR MECHANISM FOR A HIGH-VOLTAGE CIRCUIT BREAKER

The present invention is a continuation-in-part of U.S. application Ser. No. 07/283,869, filed Dec. 13, 1988,now U.S. Pat. No. 4,968,861.

The present invention relates to a stored-spring-energy actuator mechanism a high-voltage circuit breaker according to the preamble of claim 1.

Such stored-spring-energy actuator mechanisms, as are described, for example, in "SPRECHER ENERGIE REVUE" No. 1/86 on pages 4 and 5, have spring-energy accumulators which are loadable by means of an electric motor or by hand and in which the energy for switching on the high-voltage circuit breaker and also for simultaneously loading a switch-off spring accumulator can be stored. When the high-voltage switch is switched on and the spring-energy accumulator and the switch-off spring accumulator are loaded, the high-voltage circuit breaker can consequently be switched off, switched on and switched off again without the spring-energy accumulator being charged again. For reasons of reliability of supply, it is often necessary for the high-voltage circuit breaker to be able to perform a plurality of such switching actions even in the event of failure of the feed network for the drives. In order to solve this problem, it has been proposed in EP-A-0,320,614 or the corresponding U.S. patent application Ser. No. 07/283,869 to provide the loading device for charging the spring-energy accumulator with a rotating fluid motor which can be connected via a controlled valve to a local fluidpressure accumulator whose storable energy content is sufficient to be able to charge the spring-energy accumulator at least one more time. In order to ensure that this known stored-spring-energy actuator mechanism functions at low temperatures down to minus 40° Celsius or even minus 50° Celsius, very thin-bodied hydraulic oil must be used for driving the fluid motor. This thin-bodied hydraulic oil, at possible high ambient temperatures of approximately plus 40° Celsius, can lead to a noticeable reduction in the efficiency, so that the reliable functioning of the stored-spring-energy actuator mechanism can be put at risk.

Starting from this prior art, it is therefore an object of the present invention to create a stored-spring-energy actuator mechanism as defined in the preamble which functions reliably in a wide temperature range from approximately minus 40° Celsius to approximately plus 40° Celsius.

This object is achieved by the features of the defining part of claim 1.

Preferred embodiments of the stored-spring-energy actuator mechanism according to the invention are specified in the dependent claims.

The present invention and its particular mode of operation will be described in greater detail with reference to an exemplary embodiment shown in the single FIGURE. This FIGURE shows, purely schematically, a stored-spring-energy actuator mechanism according to the invention having a piston-cylinder unit for charging the spring-energy accumulator with a single working stroke.

The stored-spring-energy actuator mechanism 210 has a loading device 212 with a cylinder-piston unit 214 in order to load a spring-energy accumulator, formed by a spiral spring 216, in the course of a single working stroke in arrow direction A. The energy supplied to the spiral spring 216 during a loading operation is sufficiently great to switch on a high-voltage circuit breaker 218 (only shown schematically) and to load a switch-off spring 222 connected to the movable switch contact 220.

The inner end of the spiral spring 216 is fixed to a spring shaft 224, whose rotational axis is indicated by a dot-dash line and is designated by 224', and its outer end is connected to a lug 226 of a spring cage 228. The spring cage 228 sits in a freely rotatable manner on the spring shaft 224 which in turn, in a manner not shown but generally known, is rotatably mounted on a frame, likewise not shown, of the stored-spring-energy actuator mechanism 210.

Furthermore, on the side opposite the spring cage 228 with regard to the spiral spring 216, a loading lever 230 and a gear 232 of a gear drive 234 sit in a freely rotatable manner on the spring shaft 224. The free end area 230' of the loading lever 230 is bent at an angle and is connected to the lug 226 of the spring cage 228 and therefore to the outer end of the spiral spring 216, for example by means of a screw connection. The gear 232 is connected to the loading lever 230 via a free-wheel (not shown in the figure but generally known) which is effective during the rotation of the gear 232 against the rotational direction B for loading the spiral spring 216. The gear 232, when it rotates in the rotational direction B, therefore carries the loading lever 230 and the spring cage 228 along with it so that the spring cage 228 rotates in arrow direction B'.

Meshing with the gear 232 is a gear segment 236 which is arranged on a mounting shaft 238 running parallel to the rotational axis 224' and likewise rotatably fixed to the frame (not shown). Integrally formed on the gear segment 236 at the side of the same is a crank 240 in whose free end area, of forked configuration, the piston rod 242 of the cylinder-piston unit 214 engages, which piston rod 242 is pivotably connected to the crank 240 via a pivot pin 244. The cylinder 246 of the cylinder-piston unit 214, via fulcrum pins 248 likewise running parallel to the axis 224', is pivotably mounted on the frame (not shown) of the stored-spring-energy actuator mechanism 210 so that the cylinder-piston-unit 214, when performing a stroke in or against arrow direction A, can follow the pivoting, caused by the crank 240 rotating as a result, of the cylinder-piston unit 214 about the fulcrum pins 248. Furthermore, a restoring spring 250 is wrapped around the mounting shaft 238, which restoring spring 250 is supported at one end on the crank 240 and at the other end on a fixed pin 252 of the frame (not shown). Since the cylinder-piston unit 214 is designed to be operative only in the direction of the working stroke A, the restoring spring 250, after completion of a working stroke in arrow direction A, ensures that the piston rod 242, the crank 240 and the gear segment 236 are returned into the inoperative position shown by solid lines in the FIGURE. When a working stroke of the cylinder-piston unit 214 is performed, the gear segment 236 and the crank 240 are pivoted in arrow direction C out of the inoperative position into the working position indicated by dot-dash lines. In the process, the pivoting angle about the mounting shaft 238 is approximately 120 degrees, although this pivoting angle can also be selected to be larger or smaller. The transmission ratio of the gear drive 234 is selected in such a way that, when a working stroke of the cylinder-piston unit 214 is performed, the gear 232 is rotated through an angle of 360°.

The single-acting cylinder-piston unit 214 is connected via a line 254 to a three-way valve 256 which on the one hand, for performing a working stroke, connects the cylinder-piston unit 214 to a pressure accumulator 258 and on the other hand connects said cylinder-piston unit to a low-pressure part 260 after the working stroke is performed. For this purpose, the three-way valve 256 is connected to the pressure accumulator 258 via a high-pressure line 262 and to a low-pressure reservoir 266 via a low-pressure line 264.

A hydraulic pump 270 which can be driven by means of an electric motor 268 is connected between the low-pressure reservoir 266 and the pressure accumulator 258 in order to pump the hydraulic fluid, for example hydraulic oil, from the low-pressure reservoir 266 into the generally known hydraulic pressure accumulator 258. In this arrangement, a check valve 272 prevents the hydraulic fluid under high pressure from flowing back to the hydraulic pump 270 and the low-pressure reservoir 266. In order to prevent an excessive pressure increase in the pressure accumulator 258, the pressure accumulator 258 is hydraulically connected to a pressure-relief valve 274 which opens when pressure is too high and allows the hydraulic fluid to flow back into the low-pressure reservoir 266 until the pressure in the pressure accumulator 258 has dropped to the desired value. Likewise hydraulically connected to the pressure accumulator 258 is a pressure relay 276 whose switch contacts 278 close when the pressure in the pressure accumulator 258 drops below a lower limit value and open when an upper limit value is reached. This pressure relay 276 activates the excitation coil 280 of a switch 282, by means of which the electric motor 268 can be switched on or off.

A switch-on latch lever 284 is connected to the spring shaft 224 in such a way as to be fixed in terms of rotation, which switch-on latch lever 284 is supported in a releasable manner on a switch-on latch 286. By means of an electrically operable switch-on magnet system 288, the switch-on latch 286 can be pivoted clockwise into a release position from the supporting position shown in the figure. Furthermore, a cam plate 290 sits on the spring shaft 224 in such a way as to be fixed in terms of rotation. The radial contact surface 292 of the cam plate 290 interacts with a roller 294 which is mounted in a freely rotatable manner on a roller lever 298 firmly connected to a roller-lever shaft 296. The roller-lever shaft 296 is likewise rotatably mounted on the frame (not shown) of the stored-spring-energy actuator mechanism 210 and its axis 296' runs parallel to the rotational axis 224' of the spring shaft 224. The cam plate 290 is designed in such a way that the roller lever 298' when the cam plate 290 rotates in arrow direction D through 360°, is pivoted anticlockwise from the switch-off position shown by solid lines in the figure into the switch-on position 298' indicated by broken lines. The contact surface 292 extends over slightly less than 360° so that the roller-lever shaft 296 plus the roller lever 298 and the roller 294 can be pivoted past the edge 300 of the cam plate 290 back into the switch-off position without the roller 294 touching the cam plate 290.

Sitting on the roller-lever shaft 296 in such a way as to be fixed in terms of rotation are a switch-off latch lever 302 on one side of the roller lever 298 and a transmission lever 304 on the other side. The switch-off latch lever 302 is shown in the switch-off position by solid lines and the designation O. When the roller lever 298 is transferred into the switch-on position 298', the switch-off latch lever 302 likewise pivots anticlockwise into the switch-on position shown by dot-dash lines and designated by I. In the switch-on position I, the switch-off latch lever 302 is supported in a releasable manner on a switch-off latch 306 which can be pivoted from the position shown into a release position by means of a switch-off magnet system 308 which can be electrically activated. The transmission lever 304 is operatively connected to the movable switch contact 220 of the high-voltage circuit breaker 218 and to the switch-off spring 222 via a transmission system 310 (only indicated schematically).

A control member 312 controlling the three-way valve 256 as a function of the loaded state of the spiral spring 216 has a control shaft 314 which runs parallel to the shaft 224 and on which three single-arm levers 316, 318 and 320 are arranged. The lever 316 acts on the three-way valve 256 via a connection 322 indicated by a dot-dash line. In the position of the control member 312 shown by solid lines, the three-way valve 256 is switched in such a way that it connects the cylinder-piston unit 214 to the low-pressure reservoir 266. In the position of the control member 312 indicated by dot-dash lines and pivoted anticlockwise through about 45 degrees, the three-way valve 256 is changed over so that the pressure accumulator 258 is hydraulically connected to the cylinder-piston unit 214. In the position shown in the figure, the free end of the lever 318 bears on a tongue 324 projecting outward from the spring shaft 224 in the radial direction. When the spring shaft 224 rotates out of the position shown in arrow direction D, the lever 318 is therefore pivoted into the position indicated by dot-dash lines, which results in a change-over of the three-way valve 256. The lever 320, in the position shown by dot-dash lines, is pivoted into the path of a pin 326 arranged on the spring cage 228. If this pin 326 therefore runs onto the lever 320 during rotation of the spring cage 228 in arrow direction B', this lever 320 is pivoted back into the position shown by solid lines, which results in a change-over of the three-way valve 256 into the position shown in the FIGURE.

Furthermore, the control member 312, via the connection 322, activates a schematically indicated auxiliary switch 328 in order to signal the position of the control member 312 and therefore also the loaded state of the spiral spring 216 to, for example, a central switching station in order to monitor the stored-spring-energy actuator mechanism 210. It can readily be seen that an auxiliary switch can also be used for activating an electrically operable three-way valve (instead of the mechanically operated three-way valve 256).

A toothed rim 228' is integrally formed on the periphery of the spring cage 228 in order to connect the latter via gearing 330 to a generally known backstop 332 (only shown schematically) supported on the frame. The backstop 332 prevents the spring cage 228 from rotating against the arrow direction B'. A hand crank 334 can be coupled to a shaft 330' of the gearing 330 so that if need be the spiral spring 216 can also be loaded manually.

The stored-spring-energy actuator mechanism 210 functions as follows. In the state shown in the figure, the high-voltage circuit breaker is switched off, the switch-off spring 222 is unloaded and the spiral spring 216 is loaded. Unloading of the spiral spring 216 is prevented by the supporting of the spring cage 228 on the backstop 332 via the gearing 330 and by the supporting of the spring shaft 224 on the switch-on latch 286 by means of the switch-on latch lever 284. If the high-voltage circuit breaker 218 is now to be switched on, the switch-on magnet system 288 is excited, as a result of which the switch-on latch 286 releases the switch-on latch lever 284. The spring shaft 224 now rotates under the force of the loaded spiral spring 216 in arrow direction D, as a result of which the roller 294 comes to bear on the contact surface 292 of the cam plate 290, and the roller lever 298 plus the roller-lever shaft 296, in the course of a revolution of the cam plate 290, is pivoted through approximately 60° into the switch-on position I. The high-voltage circuit breaker 218 is switched on and at the same time the switch-off spring 222 is loaded by this pivoting of the roller-lever shaft 296. When the switch-on position I is reached, the switch-off latch lever 302 latches on the switch-off latch 306 so that the high-voltage circuit breaker 218 remains switched on, even when the contact surface 292 of the cam plate 290 runs off the roller 294. After a rotation of 360°, the switchon latch lever 284 comes to bear again on the switch-on latch 286 so that the cam plate 290 cannot rotate further either as a result of the inertia or as a result of residual preloading of the spiral spring 216.

After the release, mentioned above, of the switch-on latch lever 284 for switching on the high-voltage circuit breaker 218, the lever 318, by means of the tongue 324, is pivoted into the position shown by dot-dash lines, which results in the three-way valve 256 being changed over. The cylinder-piston unit 214 is thereby hydraulically connected to the pressure accumulator 258. Under the pressure of the hydraulic oil, the piston rod 242 performs a working stroke in arrow direction A, which results in pivoting of the gear segment 236 into the position indicated by dot-dash lines. In the course of this pivoting movement, the gear 232 is rotated through 360° in arrow direction B. This rotary movement, via the free-wheel inactive in arrow direction B, is transmitted to the loading lever 230, which results in the spiral spring 216 being loaded by one revolution while the spring cage 228 also rotates in arrow direction B'. Toward the end of this revolution, the pin 326 fixed to the spring cage 228 runs onto the lever 320, as a result of which the latter is pivoted out of the position indicated by dot-dash lines into the position shown by solid lines, which results in the three-way valve 256 being transferred into the position shown in the figure. The cylinder-piston unit 214 is now connected via the line 254 and the low-pressure line 264 to the low-pressure reservoir 266. Under the force of the restoring spring 250, the crank 240 together with the gear segment 236 is pivoted back from the position indicated by dot-dash lines into the inoperative position shown by solid lines and the piston rod 242 is moved down against arrow direction A. The now active backstop 232 prevents the spring cage 228 from also moving correspondingly against arrow direction B', and the gear 232 is decoupled from the loading lever 230 by the free-wheel active against arrow direction B.

To switch off the high-voltage circuit breaker 218, the switch-off magnet system 308 is excited so that the switch-off latch 306 releases the switch-off latch lever 302. Under the force of the switch-off spring 222, the high-voltage circuit breaker 218 is opened, and the roller-lever shaft 296 together with the roller lever 298 and the switch-off latch lever 302 is pivoted back into the position designated by O and shown by solid lines in the figure. The stored-spring-energy actuator mechanism 210 and high-voltage circuit breaker 218 are now again located in the initial position shown in the FIGURE. A few seconds are normally required for loading the spiral spring 216, whereas the high-voltage circuit breaker 218 is switched on within fractions of a second, and the switch-off action of the high-voltage circuit breaker 218 requires approximately 0.05 seconds.

It should be noted that, when spiral spring 216 is loaded and high-voltage circuit breaker 218 is switched on, the latter can be switched off by the energy stored in the switch-off spring 222, switched on again by means of the spiral spring 216 and switched off again. Now since a local pressure accumulator 258 is provided, the spiral spring 216, even if the electrical feed for the stored-spring-energy actuator mechanism 210 fails, can be immediately loaded again, which enables the high-voltage circuit breaker 218 to be switched on and off again. But the energy stored in the pressure accumulator 258 is preferably so great that the spiral spring 216 can be loaded repeatedly.

If the pressure in the pressure accumulator 258 drops below the lower pressure value set in the pressure relay 276, the switch contact 278 is closed. The activation of the excitation coil 280 caused by this leads to the closing of the switch 282, whereupon the electric motor 268 now drives the hydraulic pump 270 until a pressure is reached in the pressure accumulator 258 which corresponds to the upper pressure value set in the pressure relay 276. As soon as this pressure is reached, the switch contact 278 is opened again, which results in opening of the switch 282 and therefore in stopping of the electric motor 268. The check valve 272, when hydraulic pump 270 is switched off, prevents emptying of the pressure accumulator 258 into the low-pressure reservoir 266 by the hydraulic pump 270. If, for any reason, the pressure in the high-pressure line 262 should become too high, for example because the electric motor 268 is not stopped as a result of a malfunction of the pressure relay 276, the pressure-relief valve 274 responds in order to avoid damage caused by excessive pressure. The hydraulic system is designed in such a way that the spiral spring 216 itself can be loaded again if the pressure in the pressure accumulator 258 has dropped to such an extent that the pressure relay 276 responds but the failure of the electrical feed network prevents pumping of hydraulic oil from the low-pressure reservoir 266 into the pressure accumulator 258.

Since the efficiency of the cylinder-piston unit 214 is virtually independent of the viscosity of the hydraulic oil, the loading device 212 can be operated with thin-bodied fluid in order to ensure reliable functioning of the stored-spring-energy actuator mechanism 210 at both very low and very high temperatures. Owing to the fact that the spiral spring 216 can be loaded by a single stroke of the cylinder-piston unit 214, additional losses in the hydraulic circuit are avoided.

For adjusting and maintenance purposes or if, for any reason, the hydraulic system has to be put out of operation, the spiral spring 216 can be loaded manually by means of the hand crank 334.

A high-voltage circuit breaker can be driven in a single-pole or multi-pile manner by means of a stored-spring-energy spring-energy actuator mechanism 210. It is of course also possible for the transmission system for loading the spiral spring 216 by means of a single stroke of the cylinder-piston unit 214 to be designed differently from that described above. It is of course also conceivable to equip stored-spring-energy actuator mechanisms of different design by means of a loading device according to the invention.

I claim:

1. A stored-spring-energy actuator mechanism for a high-voltage circuit breaker, comprising a spring-energy accumulator (216) which can be charged by means of a loading device (212) having a fluid-drive element (214), means adapted to connect said spring-energy accumulator to said high voltage circuit breaker, the energy of the spring-energy accumulator (216) being sufficient for switching the high-voltage circuit breaker on and off once, and a controlled valve arrangement (256) for connecting the fluid-drive element (214) to a pressurized fluid-pressure accumulator (258) whose storable energy content corresponds at least to the stored energy of the spring-energy accumulator (216), wherein the fluid-drive element has a cylinder-piston unit (214) which performs a single working stroke for charging the spring-energy accumulator (216).

2. The stored-spring-energy actuator mechanism as claimed in claim 1, wherein said single-acting cylinder-piston unit (214) can be moved against a direction (A) of the working stroke into the inoperative position by means of a restoring element.

3. The stored-spring-energy actuator mechanism as claimed in claim 2, wherein the valve arrangement has a three-way valve (256), the three way-valve is connected to the single-acting cylinder-piston unit (214), to the pressurized fluid-pressure accumulator (258) and to a low-pressure reservoir (266), in order to connect, for charging the spring-energy accumulator (216), the pressurized fluid-pressure accumulator (258) to the cylinder-piston unit (214), and, for returning to the inoperative position, the cylinder-piston unit (214) to the low-pressure reservoir (260).

4. The stored-spring-energy actuator mechanism for a high-voltage circuit breaker, comprising a spring-energy accumulator (216) which can be charged by means of a loading device (212) having a fluid-drive element (214), the energy of the spring-energy accumulator (216) being sufficient for switching the high-voltage circuit breaker on and off once, and a controlled valve arrangement (256) for connecting the fluid-drive element (214) to a fluid-pressure accumulator (258) whose storable energy content corresponds at least to the stored energy of the spring-energy accumulator (216), wherein the fluid-drive element has a cylinder-piston unit (214) which performs a single working stroke for charging the spring-energy accumulator (216) wherein the spring-energy accumulator has a spiral spring (216), one end of which is connected to a rotatable and lockable shaft (224), which can be brought to act on a movable switch contact (220) of the high-voltage circuit breaker (218), and the other end of which is connected to a loading lever (230) mounted on the same axis as the shaft (224), and the loading lever (230), for loading the spiral spring (216), can be pivoted by means of the cylinder-piston unit (214).

5. The stored-spring-energy actuator mechanism as claimed in claim 4, wherein the spiral spring (216) has an inner end connected to the shaft (224) and an outer end connected to a spring cage (228), the spring cage sits in a freely rotatable manner on the shaft (224) and, by means of a backstop (332), is prevented from rotating against a rotational direction (B) for loading the spiral spring (216).

6. The stored-spring-energy actuator mechanism as claimed in claim 4, wherein the loading lever (230) is connected to the cylinder-piston unit (214) via a gear drive (234).

7. The stored-spring-energy actuator mechanism as claimed in claim 6, wherein a free-wheel effective against a rotational direction (B) for loading the spiral spring (216) is provided between the loading lever (230) and the cylinder-piston unit (214).

8. The stored-spring-energy actuator mechanism as claimed in claim 7, wherein the gear drive (234) has a gear (232) which is coupled to the loading lever (230) via the free-wheel and is operatively connected to a gear segment (236) which is mounted on an axis parallel to the shaft (224) and can be pivoted by means of the pistoncylinder unit (214).

9. The stored-spring-energy actuator mechanism as claimed in claim 8, wherein the gear segment (236) meshes with the gear (232) and the transmission ratio is such that the gear (232) rotates through about 360° during a working stroke of the cylinder-piston unit (214).

10. The stored-spring-energy actuator mechanism as claimed in claim 8, wherein the piston-cylinder unit (214) is pivotably mounted at one end in a fixed position and acts at the other end on a crank (240) connected to the gear segment (236).

11. The store-spring-energy actuator mechanism as claimed in claim 10, wherein the restoring element has a restoring spring (250) acting on the crank (240).

* * * * *